US007516792B2

(12) United States Patent
Lonnes et al.

(10) Patent No.: US 7,516,792 B2
(45) Date of Patent: Apr. 14, 2009

(54) REMOTE INTERVENTION LOGIC VALVING METHOD AND APPARATUS

(75) Inventors: Steven B. Lonnes, Pearland, TX (US); William A. Sorem, Katy, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/628,214

(22) Filed: Jul. 28, 2003

(65) Prior Publication Data

US 2004/0055749 A1 Mar. 25, 2004

Related U.S. Application Data

(60) Provisional application No. 60/412,728, filed on Sep. 23, 2002.

(51) Int. Cl.
*E21B 34/10* (2006.01)
*E21B 43/25* (2006.01)

(52) U.S. Cl. ..... 166/308.1; 166/373; 166/381; 166/386

(58) Field of Classification Search ..... 166/373, 166/386, 387, 141, 191, 168, 381, 179, 308.1; 340/854.3, 854.4
See application file for complete search history.

(56) References Cited

U.S. PATENT DOCUMENTS 2,991,833 A * 7/1961 Brown et al. ..... 166/313
3,033,286 A * 5/1962 Fast et al. ..... 166/264
3,098,524 A * 7/1963 Brown ..... 166/313
3,207,223 A * 9/1965 Hugel ..... 166/163
3,237,695 A * 3/1966 Bostock et al. ..... 166/120
3,702,909 A 11/1972 Kraakman
3,993,100 A 11/1976 Pollard et al.
4,185,690 A * 1/1980 Kinney ..... 166/183
4,266,606 A * 5/1981 Stone ..... 166/113
4,308,884 A 1/1982 Hoerger et al.
4,407,183 A 10/1983 Milberger et al.
4,465,139 A 8/1984 Marquez, Jr. et al. ..... 166/373
4,485,876 A * 12/1984 Speller ..... 166/373
4,549,578 A 10/1985 Hibbs et al.
4,660,647 A 4/1987 Richart
4,793,417 A * 12/1988 Rumbaugh ..... 166/312
4,865,127 A * 9/1989 Koster ..... 166/277
5,226,494 A 7/1993 Rubbo et al. ..... 166/250
5,273,112 A 12/1993 Schultz ..... 166/374
5,326,458 A 7/1994 Johnson
5,335,731 A 8/1994 Ringgenberg et al. ..... 166/336
5,704,426 A 1/1998 Rytlewski et al. ..... 166/297
5,890,536 A 4/1999 Nierode et al.
6,125,938 A 10/2000 Garcia-Soule et al. ..... 166/344
6,131,655 A * 10/2000 Shaw ..... 166/105.5
6,186,230 B1 2/2001 Nierode (Continued)

FOREIGN PATENT DOCUMENTS

EP 0 604 155 A1 12/1993

(Continued)

*Primary Examiner*—Shane Bomar
(74) *Attorney, Agent, or Firm*—ExxonMobil Upstream Research Company Law Department

(57) ABSTRACT

A system of valves in which the valves operate over a designated pressure interval and are arranged to actuate performance of a sequenced set of events by downhole tools with the application of pressure to said valves.

26 Claims, 4 Drawing Sheets

U.S. PATENT DOCUMENTS

| | | | | |
|---|---|---|---|---|
| 6,196,252 | B1 * | 3/2001 | Martin et al. | 137/102 |
| 6,293,346 | B1 * | 9/2001 | Patel | 166/373 |
| 6,388,577 | B1 * | 5/2002 | Carstensen | 340/854.3 |
| 6,450,263 | B1 * | 9/2002 | Schwendemann | 166/373 |
| 6,536,530 | B2 * | 3/2003 | Schultz et al. | 166/375 |
| 6,575,247 | B2 | 6/2003 | Tolman et al. | |
| 6,619,392 | B2 * | 9/2003 | Marangoni et al. | 166/243 |
| 6,672,405 | B2 | 1/2004 | Tolman et al. | |
| 6,760,275 | B2 * | 7/2004 | Carstensen | 367/83 |
| 6,915,856 | B2 | 7/2005 | Gentry et al. | |
| 2001/0050172 | A1 | 12/2001 | Tolman et al. | |
| 2002/0007949 | A1 | 1/2002 | Tolman et al. | |
| 2002/0112860 | A1 * | 8/2002 | McDaniel | 166/381 |

FOREIGN PATENT DOCUMENTS

| | | | |
|---|---|---|---|
| EP | 0 604 156 | A1 | 12/1993 |
| GB | 2 138 548 | A | 4/1984 |
| RU | 2 101 490 | C1 | 1/1998 |
| RU | 2 123 106 | C1 | 12/1998 |
| SU | 709803 | | 1/1980 |
| WO | WO 02/18743 | | 3/2002 |
| WO | WO 03/102349 | A2 | 11/2003 |

* cited by examiner

REMOTE INTERVENTION LOGIC VALVING METHOD AND APPARATUS

This application claims the benefit of U.S. Provisional Application No. 60/412,728 that was filed Sep. 23, 2002.

FIELD OF THE INVENTION

This invention relates generally to the field of intelligent remote intervention devices where a device performs a logical preprogrammed set of tasks via the application of an energy source. More specifically, the invention relates to an intelligent remote access valving method and apparatus useful in downhole operations.

BACKGROUND OF THE INVENTION

The majority of oil and gas reserves are located thousands of feet beneath the surface of the earth in a variety of subterranean formations. The primary goal of the oil and gas industry is to locate, access, and produce these reserves in an economic fashion. In order to access and economically produce these reserves the oil and gas industry relies upon technologies that can perform various tasks in the remote and hostile environment characteristic of subterranean formations. Examples of such tasks are, drilling, perforating, stimulating, logging, coring, fluid sampling, etc. Most remote tasks or processes are expensive, require numerous operations, rely upon skilled operators, and require an appreciable quantity of specialized equipment to achieve the desired goal. Typically, most of the expense associated with remote access is related to the amount of time that specialized equipment and trained personnel must be utilized to perform the required tasks. As a result, technologies that enable rapid, effective, and reliable remote operations increase the economic gains attainable from a given reserve by reducing the time required for remote access. The process of reservoir stimulation will be expounded upon in the forthcoming discussion to illustrate the complexities associated with remote access, and to introduce the gains attainable by applying the proposed invention to the remote access task of stimulation.

When a hydrocarbon-bearing, subterranean reservoir formation does not have enough permeability or flow capacity for the hydrocarbons to flow to the surface in economic quantities or at optimum rates, hydraulic fracturing or chemical (usually acid) stimulation is often used to increase the flow capacity. A wellbore penetrating a subterranean formation typically consists of a metal pipe (casing) cemented into the original drill hole. Holes (perforations) are placed to penetrate through the casing and the cement sheath surrounding the casing to allow hydrocarbon flow into the wellbore and, if necessary, to allow treatment fluids to flow from the wellbore into the formation.

Hydraulic fracturing consists of injecting fluids (usually viscous shear thinning, non-Newtonian gels or emulsions) into a formation at such high pressures and rates that the reservoir rock fails and forms a plane, typically vertical, fracture (or fracture network) much like the fracture that extends through a wooden log as a wedge is driven into it. Granular proppant material, such as sand, ceramic beads, or other materials, is generally injected with the later portion of the fracturing fluid to hold the fracture(s) open after the pressure is released. Increased flow capacity from the reservoir results from the flow path left between grains of the proppant material within the fracture(s). In chemical stimulation treatments, flow capacity is improved by dissolving materials in the formation or otherwise changing formation properties.

Application of hydraulic fracturing as described above is a routine part of petroleum industry operations as applied to individual target zones of up to about 60 meters (200 feet) of gross, vertical thickness of subterranean formation. When there are multiple or layered reservoirs to be hydraulically fractured, or a very thick hydrocarbon-bearing formation (over about 60 meters), then alternate treatment techniques are required to obtain treatment of the entire target zone.

When multiple hydrocarbon-bearing zones are stimulated by hydraulic fracturing or chemical stimulation treatments, economic and technical gains are realized by injecting multiple treatment stages that can be diverted (or separated) by various means, including mechanical devices such as bridge plugs, packers, downhole valves, sliding sleeves, and baffle/plug combinations; ball sealers; particulates such as sand, ceramic material, proppant, salt, waxes, resins, or other compounds; or by alternative fluid systems such as viscosified fluids, gelled fluids, foams, or other chemically formulated fluids; or using limited entry methods.

In mechanical bridge plug diversion, for example, the deepest interval is first perforated and fracture stimulated, then the interval is typically isolated by a wireline-set bridge plug, and the process is repeated in the next interval up. Assuming ten target perforation intervals, treating 300 meters (1,000 feet) of formation in this manner would typically require ten jobs over a time interval of ten days to two weeks with not only multiple fracture treatments, but also multiple perforating and bridge plug running operations. At the end of the treatment process, a wellbore clean-out operation would be required to remove the bridge plugs and put the well on production. The major advantage of using bridge plugs or other mechanical diversion agents is high confidence that the entire target zone is treated. The major disadvantages are the high cost of treatment resulting from multiple trips into and out of the wellbore and the risk of complications resulting from so many operations in the well. For example, a bridge plug can become stuck in the casing and need to be drilled out at great expense. A further disadvantage is that the required wellbore clean-out operation may damage some of the successfully fractured intervals.

To overcome some of the limitations associated with completion operations that require multiple trips of hardware into and out of the wellbore to perforate and stimulate subterranean formations, methods and apparatus have been proposed for "single-trip" deployment of a downhole tool assembly to allow for fracture stimulation of zones in conjunction with perforating. Specifically, these methods and apparatus allow operations that minimize the number of required wellbore operations and time required to complete these operations, thereby reducing the stimulation treatment cost. The tool strings used for these types of applications can be very long and the tool must complete a large number of tasks in a remote downhole environment. The tool string hardware that is assembled to complete these downhole tasks is generally referred to as a bottom hole assembly or "BHA."

An apparatus and method is needed that: 1) independently performs numerous operations downhole; 2) independently performs the operations in a preprogrammed logical sequence; 3) independently performs the operations at the proper time; 4) uses pressure as the primary basis for control and actuation; 5) is capable of numerous independent cycles in a single trip; 6) eliminates the need for operator interaction; and 7) provides the flexibility to incorporate the most reliable and proven hardware designs (annular or non-annular based designs). The result would be a highly reliable intelligent BHA capable of single trip multi-use remote access with little or no surface interaction, essentially a pressure driven downhole computer or downhole brain.

SUMMARY OF THE INVENTION

In one embodiment of the present invention, a system of two or more valves is disclosed wherein said valves operate over a designated pressure interval and are arranged to actuate performance of a sequenced set of events by one or more downhole tools with the application of pressure to said valves. In one embodiment of a system according to this invention, one or more of said valves is a cartridge valve; and in a particular embodiment, at least one of said cartridge valves is a single purpose cartridge valve. In one embodiment of a system according to this invention, one or more of said valves is an annular-based valve. In one embodiment of a system according to this invention, said set of events are selected from the group consisting of packer actuation, pressure equalization, wash-fluid flow actuation, perforating device actuation, slips actuation, wire line actuation, electrical device actuation, measurement device actuation, sampling device actuation, deployment means actuation, downhole motor actuation, generator actuation, pump actuation, communication system actuation, fluid injection, fluid removal, heating, cooling, bridge plug actuation, frac plug actuation, optical device actuation, BHA release actuation, drilling operation, cutting operation, expandable tubing operation, expandable completion operation, and mechanical device actuation. In one embodiment of a system according to this invention, said valves operate one or more remote electrical devices that communicate with a command base via a wireline. In one embodiment of a system according to this invention, said valves operate one or more remote electrical devices that are powered at a remote location without requiring wireline support. In one embodiment of a system according to this invention, at least one of said valves is adapted to allow fluid to flow therethrough in only one direction. In one embodiment of a system according to this invention, at least one of said valves is adapted to cause fluid flow therethrough to cease when said fluid flow reaches a predefined rate or imposes a predefined pressure upon said valve. One skilled in the art has the ability to predefine said predefined rate and/or said predefined pressure based upon the application in which a system according to this invention is to be used. In one embodiment of a system according to this invention, at least one of said valves is adapted to allow fluid to flow therethrough when said fluid flow imposes a predefined pressure upon said valve. One skilled in the art has the ability to predefine said predefined pressure based upon the application in which a system according to this invention is to be used. In one embodiment, a system according to this invention comprises at least one screen adapted to filter solids having predefined dimensions from fluids before said fluids flow through one or more of said valves, or through said system. One skilled in the art has the ability to predefine said predefined dimensions of the solids to be filtered based upon the application in which the system will be used. In one embodiment, a system according to this invention comprises at least one burst disk adapted to allow fluid flow out of one or more of said downhole tools under one or more predefined conditions. One skilled in the art has the ability to predefine said predefined conditions based upon the application in which the system will be used. In one embodiment, a system according to this invention comprises one or more orifices adapted to limit flow of fluid through said system to a predefined flowrate. One skilled in the art has the ability to predefine said predefined flowrate based upon the application in which the system will be used. In one embodiment, a system according to this invention comprises one or more orifices adapted to limit flow of fluid through one or more of said valves to a predefined flowrate. One skilled in the art has the ability to predefine said predefined flowrate based upon the application in which the system will be used.

In another embodiment, a method for perforating and treating multiple intervals of one or more subterranean formations intersected by a wellbore is disclosed, said method comprising the steps of: a) deploying a bottom-hole assembly ("BHA") from a tubing string within said wellbore, said BHA having a perforating device and a sealing mechanism; b) using said perforating device to perforate at least one interval of said one or more subterranean formations; c) positioning said BHA within said wellbore and activating said sealing mechanism so as to establish a hydraulic seal below said at least one perforated interval; d) pumping a treating fluid down the annulus between said tubing string and said wellbore and into the perforations created by said perforating device, without removing said perforating device from said wellbore; e) releasing said sealing mechanism; and f) repeating steps (b) through (e) for at least one additional interval of said one or more subterranean formations; wherein at least one of said steps is actuated by a system of valves that operates over a designated pressure interval and is arranged to actuate performance of said step with the application of pressure to said valves. In one embodiment, additional steps are performed, said steps being selected from the group consisting of washing debris from around said sealing mechanism, equalizing pressure across said sealing mechanism, and establishing electrical communication through said sealing mechanism.

In yet another embodiment, an apparatus is disclosed for actuating performance of a sequenced set of events by one or more downhole tools with the application of pressure over a designated pressure interval comprising a combination of two or more valves arranged as sub-assemblies wherein one sub-assembly communicates with another sub-assembly through pressure isolating connections. In one embodiment of an apparatus according to this invention, said valves are cartridge valves housed within said sub-assemblies. In one embodiment of an apparatus according to this invention, pressure communication is established both between said valves and between said sub-assemblies by said pressure isolating connections. In one embodiment of an apparatus according to this invention, wireline communication is provided through said sub-assemblies. In one embodiment of an apparatus according to this invention, at least one of said valves is adapted to allow fluid to flow therethrough in only one direction. In one embodiment of an apparatus according to this invention, at least one of said valves is adapted to cause fluid flow therethrough to cease when said fluid flow rate reaches a predefined rate or imposes a predefined pressure upon said valve. One skilled in the art has the ability to predefine said predefined rate or said predefined pressure based upon the application in which the apparatus will be used. In one embodiment of an apparatus according to this invention, at least one of said valves is adapted to allow fluid to flow therethrough when said fluid flow imposes a predefined pressure upon said valve. One skilled in the art has the ability to predefine said predefined pressure based upon the application in which the apparatus will be used. In one embodiment, an apparatus according to this invention comprises at least one screen adapted to filter solids having predefined dimensions from fluids before said fluids flow through one or more of said valves. One skilled in the art has the ability to predefine said predefined dimensions based on the application in which the apparatus will be used. In one embodiment, an apparatus according to this invention comprises at least one burst disk adapted to allow fluid flow out of one or more of said downhole tools under one or more predefined conditions. One skilled in the art has the ability to predefine said predefined conditions based upon the application in which the apparatus will be used. In one embodiment, an apparatus according to this invention comprises one or more orifices adapted to limit flow of fluid through one or more of said valves to a predefined flowrate. One skilled in the art has the ability to predefine said predefined flowrate based upon the application in which the apparatus will be used.

BRIEF DESCRIPTION OF THE DRAWINGS

The present invention and its advantages will be better understood by referring to the following detailed description and the attached drawings in which.

DETAILED DESCRIPTION OF THE INVENTION

Figure 1:
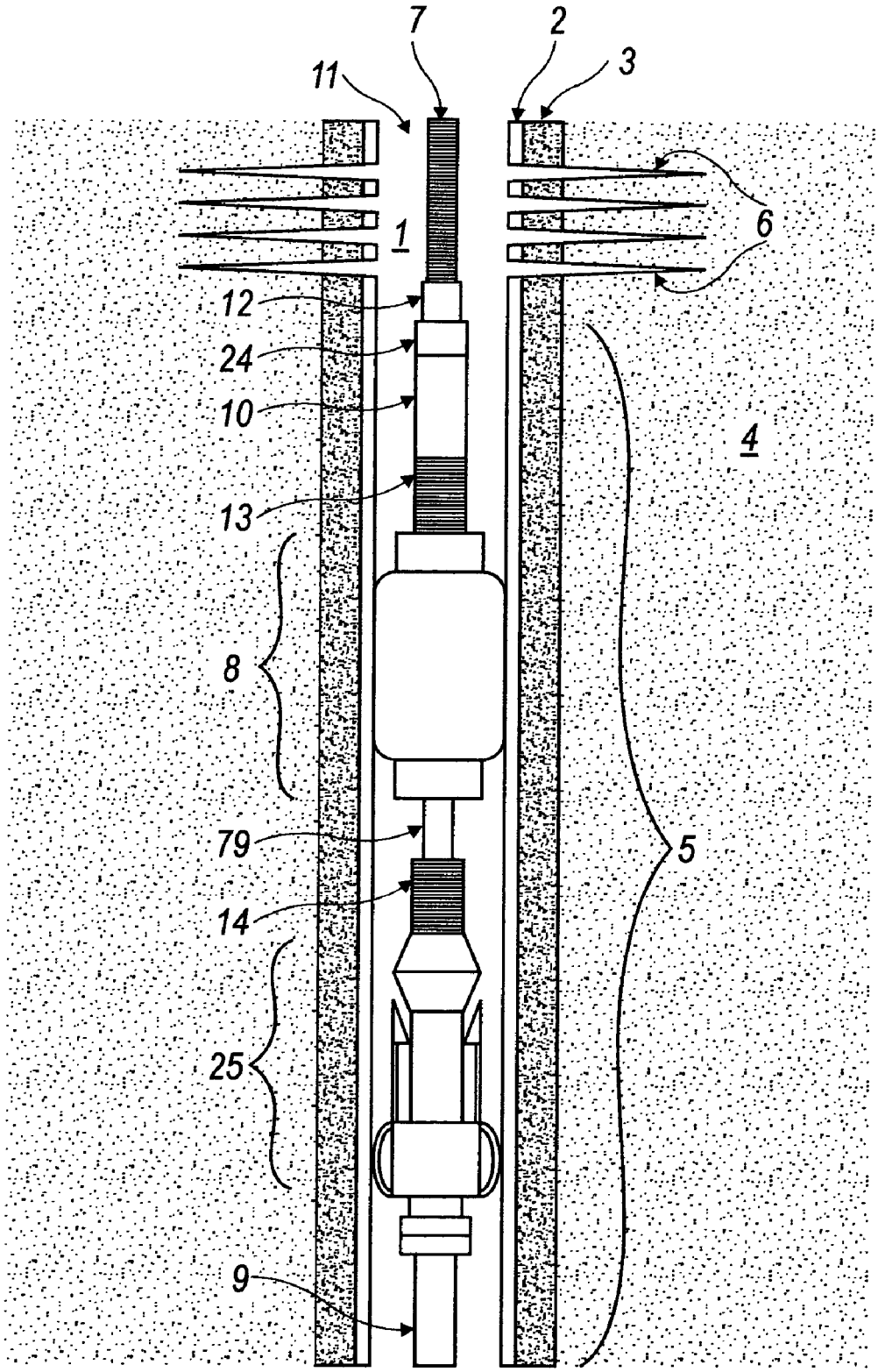
FIG. 1 is a schematic diagram of a downhole tool assembly in a wellbore of which the Remote Intervention Logic Valve (RILV) circuit is a part.

The present invention will be described in connection with various embodiments. However, to the extent that the following description is specific to a particular embodiment or a particular use of the invention, this is intended to be illustrative only, and is not to be construed as limiting the scope of the invention. On the contrary, the description is intended to cover all alternatives, modifications, and equivalents that are included within the spirit and scope of invention, as defined by the appended claims.

Stimulation of a single producing interval typically requires a sequence of events to occur in the proper order. A possible fracture treatment that uses a coiled tubing deployed inflatable packer to divert stimulation fluids that are pumped into perforations above the packer may include the following operations: running a deflated packer to the desired depth while circulating fluid through the coiled tubing; perforating; moving the BHA to location; washing debris from the setting location; setting slips; inflating the packer; equalizing pressure across the packer during inflation; closing the pressure equalization path; stimulating the reservoir; opening the packer equalization path; deflating the packer; releasing slips; and washing debris. In practice each of the thirteen events listed would also have a subset of events required to achieve the listed event, for example, setting 'J' latch slips requires lowering the BHA downhole, lifting the BHA uphole two feet, and lowering the BHA downhole two feet. Although this example illustrates the inherent complexity associated with most remote operations, an actual operation becomes even more complex when the logistics associated with the surface operations required to generate the downhole event are considered. Downhole events such as these are typically initiated and actuated from the surface using one or more of the following control elements to create a single downhole operation: 1) tension and/or compression; 2) rotation; 3) pumping a ball downhole to seal a port, i.e., "ball dropping"; 4) electricity; and 5) pressure.

Each of the five surface control elements present complications and limitations to a remote intervention program. The reliance on tension and compression as practiced in the art becomes a liability in highly deviated wells (wells that are drilled both vertical and at various angles from vertical) where the transmission of force from the surface to the BHA can be partially or totally attenuated by frictional contact between the coiled tubing and the casing walls. Additionally, temperature changes to the tubing string from the passage of cool/hot stimulation fluids can change the force conveyed to the BHA during the stimulation activity, thus increasing the challenges associated with load sensitive surface control. Furthermore, the BHA must be anchored firmly to the casing walls during the load control operations otherwise the applied loads could move the BHA uphole or downhole relative to the desired stimulation interval and possibly damage the BHA's diversion device (the BHA component that is firmly sealed against the wall of the casing). Moreover, if tension or compression are used to activate a downhole device that changes in length with applied load (e.g., a sliding sleeve), complications arise if a fixed length of wireline is required to pass through the expanding and contracting device.

The use of rotation as generally applied in the industry requires the transmission of a torque (twisting motion) from the surface to the BHA. Jointed tubing (pipe that is screwed together in 9.1 meter (30 foot) sections) is typically used to transmit torque to a BHA because of its inherent mechanical integrity. The following list outlines the primary shortcomings associated with this BHA control approach: 1) a large amount of time is required to move the BHA thousands of feet uphole and downhole by screwing and unscrewing numerous 9.1 meter (30 foot) sections of pipe; 2) if the tubing becomes stuck, communication to the BHA is lost; 3) activities that require the use of jointed tubing also require the use of an expensive rig to connect and disconnect the numerous sections of jointed tubing; and 4) because jointed tubing is constantly added and removed in 9.1 meter (30 foot) sections, the inclusion of an electrical wireline through the center of the tubing string is not practical, thus the electrical actuation of such devices as perforating guns is not practical.

Ball dropping is typically accomplished by transporting a ball from the surface to a BHA through coiled tubing or jointed tubing. When the ball reaches the BHA it seals a port within the tool and enables the actuation of an event. The primary shortcomings associated with ball dropping are: 1) ball dropping is typically a one time irreversible event (various sized balls can be dropped during a given procedure, but none of the BHA actuations created by a given ball can be repeated), thus the ability to perform multiple stimulations during a single trip into a wellbore is limited; 2) the introduction of a source of human error, for example, dropping the wrong sized ball, neglecting to drop a ball, dropping a ball at the wrong time; 3) the need for a ball to seal in a debris laden environment; 4) potential complications if a wireline is present within the tubing. Ball dropping has other remote access applications outside the realm of BHA actuation, for example, short term sealing of perforation holes in casing, or sealing ports in permanent or temporary devices anchored to casing or production tubing.

The use of electricity downhole is typically enabled by the passage of a water-tight insulated wireline from a control center on the surface to a BHA downhole. A BHA is typically suspended and transported by a wireline, or suspended and transported by a tubing string with a wireline passing through the inside of the tubing. Because electricity and wellbore liquids are incompatible, downhole electrical circuitry is typically housed in sealed air-tight chambers. The following list outlines the primary limitations associated with the use of electricity for the control and actuation of downhole devices: 1) the failure of a seal, or minor leakage from a seal, can readily incapacitate a downhole device, thus rendering it unusable, or depending upon the state of the BHA at the time of failure, leaving the tool rigidly locked into the hole and unusable; 2) numerous moving parts are generally required because the electrical energy must be converted into mechanical energy (within the small confines of a downhole tool) and then used to actuate another mechanical device that performs the required downhole operation, thus increasing the statistical likelihood of failure; 3) loss of wireline communication renders the tool inoperable, which can be unfavorable if a tool is rigidly locked to the wellbore when communication is lost; 4) air-filled sealed circuitry chambers become susceptible to collapse from hydrostatic pressures within the wellbore; 5) if a wireline is used alone there is very little uphole pull capacity to free a BHA that may become stuck or slightly wedged; and 6) the elevated temperatures that are common to the downhole environment can adversely impact the performance of electrical devices.

Of the five control elements, pressure typically provides the best form of control and actuation energy. All wellbores contain fluid, thus a pressure communication link between a BHA and the surface is always available, even in upset conditions. Since pressure is also an energy source, the ability to operate pressure actuated devices is always available, even in upset conditions. A notable intricacy associated with pressure controlled and pressure actuated devices is the case specific need to separate a BHA control pressure from the natural pressures occurring within a reservoir, or the pressures associated with a separate downhole operation, for example, fracturing.

The fore mentioned stimulation example illustrates the complexity associated with a typical remote intervention (thirteen events with each event containing numerous supporting events). The actuation of these downhole events relies upon the skilled execution of an appropriate set of surface maneuvers selected from the fore mentioned five elements. The combination of intervention complexity with the operational challenges and limitations associated with the five surface control elements highlights the difficulties that can arise in a remote access program due to the number of downhole events, the associated event logic, the event timing, and the nature of the surface maneuvers required to generate each downhole event.

A shortcoming associated with current remote access technology is related to the design basis used to construct the downhole tools (BHAs). Standard industry practice relies upon annular based designs to create systems capable of performing the necessary task, or tasks, in a remote environment. Annular valving designs generally confine the working mechanisms of a valve to an annular region and are primarily comprised of numerous interdependent sleeves that slide relative to each other with applied load (load via pressure, ball drop plus pressure, spring, direct movement, etc). Typically, annular-based systems require that energized seals (seals with a differential pressure across them) pass over ports (holes) to generate a required downhole event. For example, assume that a pipe has a hole in it and there is a given pressure outside of the pipe. Also assume that the outer pipe has a slightly smaller diameter inner pipe that can slide axially within the outer pipe and assume it is approximately 25.4 cm (10 inches) long. The pressure outside the pipe can be isolated from the pressure inside the pipe by placing seals on both ends of the inner moveable pipe and centering it over the hole. When a pressure difference exists between the outside and inside of the outer pipe the seal material is driven into the small seam between the two pipes and prevents the passage of fluid. To create communication between the outside and inside of the outer pipe, the inner pipe must be slid axially until one of the seals passes over the hole in the outer pipe. Seal materials are generally soft and rubber-like. The passage of these pressure energized seals over a port adversely impacts the reliability of a device because the soft seal material can be easily damaged by the edge of the hole and can be easily damaged by the surge of fluid across the unconfined seal when pressure communication is established. Although an annular design permits a passage through the center of a device, it necessarily excludes proven higher quality hardware that is not annular based.

One embodiment of the present invention provides a system of valves that operates over a designated pressure interval wherein the valves are arranged to actuate performance of a sequenced set of events by downhole tools with the application of pressure to said valves. The system of valves is conceptually similar to an electrical circuit. An electrical circuit is designed to perform a logical set of tasks by systematically wiring numerous simple single function components (i.e., resistors, capacitors, transistors, diodes, etc.) together and applying a voltage. Likewise, in one embodiment of the invention, the system of valves can be programmed to perform a logical set of tasks by systematically plumbing numerous special purpose valves (for example, numerous single function cartridge valves such as check valves, relief valves, shuttle valves, velocity fuses, pilot operated relief valves, regulators, back pressure regulators, etc.) together and applying a pressure. The inherent ability of the system of valves to initiate and perform numerous operations at a remote location via an applied pressure provides unique and enabling remote access capabilities.

Remote access challenges resulting from the number of downhole events, the associated event logic, the timing of events, and the nature of the surface maneuvers required to generate each downhole event are alleviated by the present invention. Compared to current technology that requires skilled operators at the surface doing the thinking and actions required to generate each downhole event, this invention provides apparatus and methods that simulate the thinking process of the surface operator or team of operators, thus, mitigating the potential for human error.

The system of valves limits or eliminates the need for surface operator derived logical control using axial movement, rotation, ball dropping, or electrical impulse. In addition, because the system of valves is pressure based, the invention provides a simplifying and enabling technology for remote access processes that are limited by the shortcomings of the non-pressure based control approaches, for example operations in deviated and horizontal wellbores.

Various embodiments of the present invention provide application specific valve systems that enable the independent execution of a logical pre-programmed set of tasks, in the proper order, at the proper time, via applied pressure over a determined pressure range. A "task" as used herein means any remote event required of a subterranean formation access program. Examples of a task include inflating a packer, performing washing operations, acidizing, fracturing, equalizing pressure across a wellbore seal device, squeeze operations, bridge plug deployment, operation of a mechanical device (slips, decentralizer, compression packer, grapple, cutting tool, formation drill bit, valve, electrical switch, etc), and operation of an electrical device (switch, select-fire perforating gun, etc.). Consequently, the proper operation of numerous remote access technologies is potentially enabled and simplified by various embodiments of the invention.

An apparatus associated with a particular embodiment of the invention described below is referred to as a Remote Intervention Logic Valve (RILV). A primary, but not limiting, function of the RILV is to remotely perform BHA operations that can be used to isolate a specific length of a wellbore for remote access purposes such as fracturing, acidizing, spotting clean-up fluids, water shut-off, gas-shut-off, recompletion of an existing well by perforating and stimulating in a wellbore location different than the existing completion, and wellbore performance diagnostics (for example, isolating, sampling, and analyzing fluids and pressures from select zones).

An RILV has been fabricated, and has undergone cursory testing, to remotely perform BHA operations that support single-trip, multi-zone stimulation and wellbore isolation operations using a coiled tubing deployed inflatable packer. FIG. 1 illustrates a simplified system of a downhole tool assembly in which the RILV is useful. Wellbore 1 is cased with casing 2, which has been cemented in place by cement 3. Hydraulic communication has been established between wellbore 1 and subterranean formation 4, through the casing and cement, by perforations 6. Downhole assembly 5 is deployed with deployment means, such as coiled tubing, 7 into wellbore 1. Coiled tubing 7 provides flow and pressure to RILV 10. Wash and circulation flow eject from wash tool 24 which may be a sub-component of RILV 10. Inflatable packer 8 is connected below RILV 10. Equalization fluid communication is provided between screens 13 and 14 through mandrel 79. Fluid can flow between screens 13 and 14 in either direction. A select-fire perforating system 9 is connected below slips 25. Downhole assembly 5 may be deployed by any suitable means, including jointed tubing, tractor devices or wireline, and is not limited to coiled tubing. Annulus 11 is the space that exists between casing 2 and downhole assembly 5 as well as between casing 2 and deployment means 7. Other tools may be included in the downhole tool assembly.

For a single-trip multi-zone stimulation, an example of a possible sequence of events performed by downhole assembly 5 would include: 1) run the deflated packer to the desired depth while circulating fluid through the coiled tubing; 2) perforate; 3) move the BHA below the perforations; 4) set the slips; 5) wash debris from the packer setting location; 6) inflate the packer; 7) equalize pressure across the packer during inflation; 8) close the pressure equalization path after packer inflation; 9) execute the stimulation program; 10) open the equalization port prior to packer deflation; 11) wash any residual stimulation material from the packer location; 12) deflate the packer; 13) release the slips; and 14) circulate fluid through the coiled tubing during packer transit.

The RILV 10 is primarily comprised of a combination of various cartridge valves that perform fluid control logic as a function of applied pressure. For the purpose of this document, a cartridge valve is defined as a single, or special purpose, self-contained valve that can be freely inserted and removed from an enclosing cavity, or partially enclosing cavity, or attached to a pressure source. The cartridge valve could be screwed into the cavity, or pressure source, or installed and confined into the cavity by others means, for example, by a threaded cap or by abutment with the surface of an adjacent body.

Cartridge valves used in RILV 10 are not limited by the shortcomings of annular based designs. As a quality control measure, simple laboratory testing of individual cartridge valves can be performed prior to installation into a downhole tool as a means of ensuring the functionality and integrity of the system. As long as each valve performs the specific task(s) that it was exclusively designed to perform, the system of valves will execute repeatably and reliably, regardless of the complexity of the event sequence.

RILV 10 performs several primary tasks: 1) provides circulation while the tool is run into the hole; 2) inflates an inflatable packer; 3) enables pressure equalization flow uphole through the tool whenever the pressure is higher below the packer than above the packer; 4) equalizes pressure from above the packer to below the packer while the packer is inflating; 5) seals the wellbore after the packer is fully inflated; 6) enables washing while the packer is set; 7) provides wash flow while the packer is deflated; 8) enables packer deflation; and 9) provides packer over-inflation pressure protection.

Figure 2:
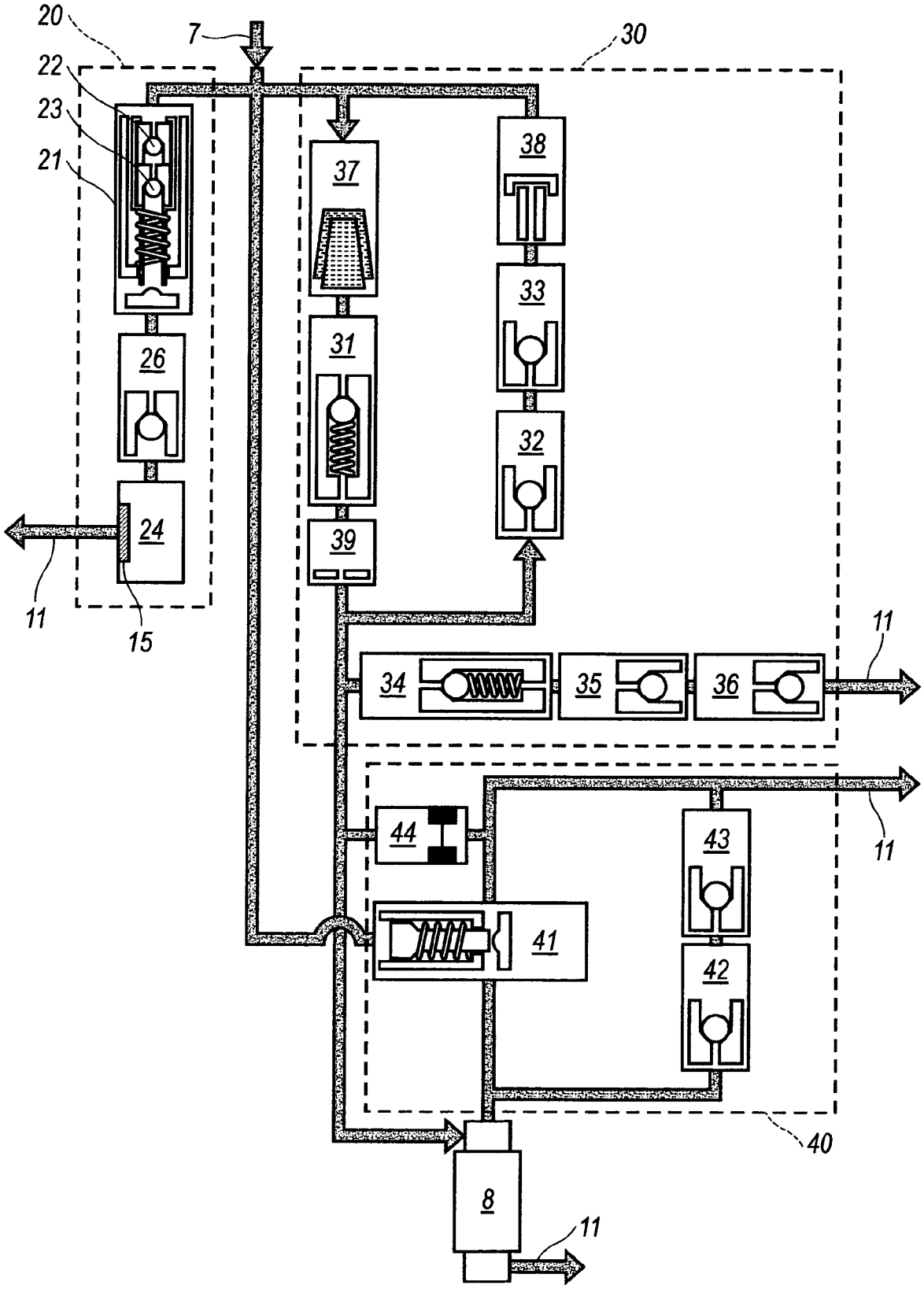
FIG. 2 is a schematic diagram of an RILV circuit design useful in a single-trip, multi-zone stimulation treatment such as hydraulic fracturing.

An overview of the RILV circuit is presented in FIG. 2. All of the valves shown in FIG. 2, e.g., valves 21-23, 26, 31-36, and 41-43, are cartridge valves. The valves enclosed within the dashed boxes identify a cartridge valve family that performs a specified task. For example, wash tool family 20 contains a family of four valves, velocity fuse 21, first check valve 22, second check valve 23, and third check valve 26, that actuate wash tool 24. The following discussion addresses the operation of each cartridge valve family. This is followed by a discussion of the operational sequence of the total valve assembly.

Wash tool family 20 enables flow from coiled tubing 7 to the annulus, but restricts flow from the annulus to coiled tubing 7. Wash tool 24 actuates over a discrete pressure interval and facilitates washing of debris from around packer 8 before and after packer inflation as well as circulation during tool movement and/or the movement of fluid(s) uphole or downhole. Wash tool family 20 can also provide supplemental fluid for fracturing and/or fluid to mitigate debris accumulation on top of a downhole assembly during a stimulation process. Velocity fuse 21 is a spring based system that is held open by spring force until sufficient pressure drop is achieved by the fluid passing through the valve to compress the springs and close the valve. The valve is then held closed by the applied differential pressure. The flow area through the valve, springs, and piston displacement are selected to ensure that the desired flow rate passes through the valve before the predetermined closure pressure is reached. The valve operates on differential pressure, thus its performance is not static pressure dependent (depth dependent). First check valve 22, second check valve 23, and third check valve 26, are a redundant set of valves that ensure the direction of flow is limited to that of coiled tubing 7 to annulus 11. These check valves limit cross contamination between the clean controlled coiled tubing fluid and the uncontrolled annular fluid. Screen 15 provides an adequately large flow area to assist with the removal of packed proppant or debris from around the BHA. In addition, screen 15 provides upset condition protection against the invasion of debris laden fluid into the coiled tubing if valves 22, 23, and 26 fail.

Packer inflation valve family 30 enables controlled inflation and deflation of the packer over a discrete pressure interval and comprises packer inflation screens 37, first relief valve 31, packer inflation orifice 39, first check valve 32, second check valve 33, packer deflation orifices 38, second relief valve 34, third check valve 35 and fourth check valve 36. For various reasons it is not desirable to inflate the packer over the same pressure interval in which the wash tool operates. One reason is that the use of circulation flow during tool movement (tripping) would promote packer inflation, thus tool movement would be prevented. A second reason is that controlled washing while the packer is deflated would not be possible. The packer is inflated over a discrete pressure interval that begins at a pressure greater than the closing pressure of the wash tool. Packer inflation screens 37 restrict the particle size introduced to packer inflation valve family 30 during the process of packer inflation. First relief valve 31 is used to deter packer inflation until the desired opening, or "cracking", pressure is reached. After the desired cracking pressure is surpassed the packer inflates to a pressure equal to the coiled tubing pressure minus the re-seating pressure (nominally equal to the cracking pressure). Thus, the pressure within the packer is less than the coiled tubing pressure by a predetermined value. The stimulation activity is performed while maintaining the coiled tubing pressure within the pressure range between the maximum coiled tubing packer inflation pressure and the packer pressure. This pressure interval is nominally equal to the magnitude of the "cracking" pressure of the relief valve. Packer inflation orifice 39 limits the flow rate into packer 8 to enable a controlled and uniform inflation of packer 8. To deflate the packer a redundant pair of check valves, first check valve 32 and second check valve 33, and packer deflation orifices 38, are used to bypass the packer inflation relief valve, i.e. first relief valve 31. During inflation the two check valves 32 and 33 are closed, but during deflation the two valves open as soon as the coiled tubing pressure drops below the packer pressure. Packer deflation orifices 38 limit the deflation flow rate to protect valves 32 and 33 from the detrimental impact of high velocity fluid flow. Reducing the coiled tubing pressure to hydrostatic pressure enables the packer to completely deflate. The deflation is actuated by the elastic properties of the packer element and can be assisted by the application of annular pressure and/or unloading the coiled tubing hydrostatic pressure via the introduction of a fluid with a density lower than the annular fluid, e.g., gas. The three remaining valves in packer inflation family 30 provide protection against over-inflation of the packer. If the pressure within the packer increases to a value greater than a preset pressure, the packer inflation fluid is directed to the annulus via pressure relief valve 34, third check valve 35 and fourth check valve 36. In addition, check valves 35 and 36 provide a redundant system that prevents flow from annulus 11 to packer 8.

Equalization valve family 40 provides a pressure actuated means of equalizing differential pressure across the packer, and comprises pilot operated relief valve 41, first check valve 42, second check valve 43, and burst disk 44. This is done during and after the inflation process to protect the packer element and tubing string from potentially damaging zone-to-zone crossflow effects. Examples of these potentially damaging effects are coiled tubing buckling during packer inflation resulting from the movement of formation fluids uphole in a crossflowing interval, sand blasting of the packer element during deflation due to the passage of a high velocity particle laden fluid between the confining wall and the partially deflated packer, and an undesirable load surge during deflation resulting from the loss of frictional restraint under the influence of a differential pressure acting on the surface area of the nominally inflated packer. Pilot operated relief valve 41 is used to open a pressure and flow communication path across packer 8. A spring is used to maintain a normally open condition. The application of a preset coiled tubing pressure compresses the springs and closes the valve. Upon inflation of the packer, the pressure is equalized across the packer until the packer element is firmly set against the confining walls, after which the valve closes at its preset coiled tubing pressure. Upon deflation of the packer, the valve opens at the preset coiled tubing pressure and enables pressure equalization while the element unseats from the confining walls and deflates. For the specific case where the stimulation process occurs above the packer, a redundant pair of check valves 42 and 43 bypass pilot operated relief valve 41 and ensure that an elevated pressure is not allowed to develop below the packer, before and after the stimulation process. Check valves 42 and 43 could be replaced with solid metal blanks if the stimulation process was designed to occur below the packer. Burst disk 44 provides a mechanism for deflation of packer 8 under upset conditions. An upset condition in which burst disk 44 may be utilized would be a situation in which the pressure in casing 2 (see FIG. 1) above and/or below packer 8 is lower than the hydrostatic pressure within coiled tubing 7 (see FIG. 1) and a reduction in coiled tubing hydrostatic pressure by pumping a lower density fluid (gas) into coiled tubing 7 is not possible due to a wellbore blockage or valving failure that prevents wash flow from coiled tubing 7 to annulus 11. The rupture of burst disk 44 opens a flow and pressure communication path between the pressures above and below packer 8 within casing 2. After burst disk 44 is ruptured, deflation occurs as the stretched elastomer covering on packer 8 pushes the packer fluid through burst disk 44 and into the region above or below packer 8.

Since each valve family operates over a configurable pressure interval, and the valves comprising the system are exchangeable, the operation and/or operational sequence can be modified to accommodate the requirements of any given application. In one embodiment of the invention, an apparatus is provided that uses a cartridge valve system organized in such a way that a downhole tool can perform a logical set of events via an applied pressure.

A method for using such an apparatus could involve perforating an interval, lowering the downhole tool assembly below the perforations, setting the inflatable packer, fracturing the formation by pumping proppant laden fluid through the annulus, releasing the packer and moving uphole to the next perforating location. The primary challenges involved with this application are the inflation of the packer in a region of the wellbore where the existence of uphole crossflow could helically buckle the coiled tubing, removal of sand from the top of the packer after the fracturing process, and the equalization of pressure above and below the packer prior to packer deflation.

It is assumed for this example that the inflatable packer manufacturer suggests inflating the packer to about 34 MPa (5000 psi) and the maximum fracture pressure anticipated is about 41 MPa (6000 psi) (screen-out). To accommodate the application requirements, the following activation pressures are assumed for the three valve families: 1.) velocity fuse 21 of wash tool family 20 is configured to close at a differential pressure of about 10 MPa (1500 psi); 2.) relief valve 31 of packer inflation valve family 30 is configured to open at a differential pressure of about 24 MPa (3500 psi); and 3.) pilot operated relief valve 41 of equalization valve family 40 is configured to close between the differential pressures of about 34 MPa (5000 psi) and about 52 MPa (7500 psi). For this specific application, check valves 42 and 43 are included in the system. Since the maximum anticipated pressure is about 41 MPa (6000 psi), and the velocity fuse is set to activate (open or close) with about 10 MPa (1500 psi) of differential pressure between the coiled tubing and annulus, the coiled tubing pressure must be maintained at a pressure higher than about 52 MPa (7500 psi) (about 42 MPa (6000 psi)+about 10 MPa (1500 psi)) to prevent the velocity fuse from opening and also to provide protection against coiled tubing collapse. Consequently, it is assumed that coiled tubing pressure will be maintained at about 59 MPa (8500 psi) during the fracture operation. Since the maximum expected packer pressure is about 34 MPa (5000 psi), a rupture pressure of about 41 MPa (6000 psi) is assumed for burst disk 44.

Figure 3:
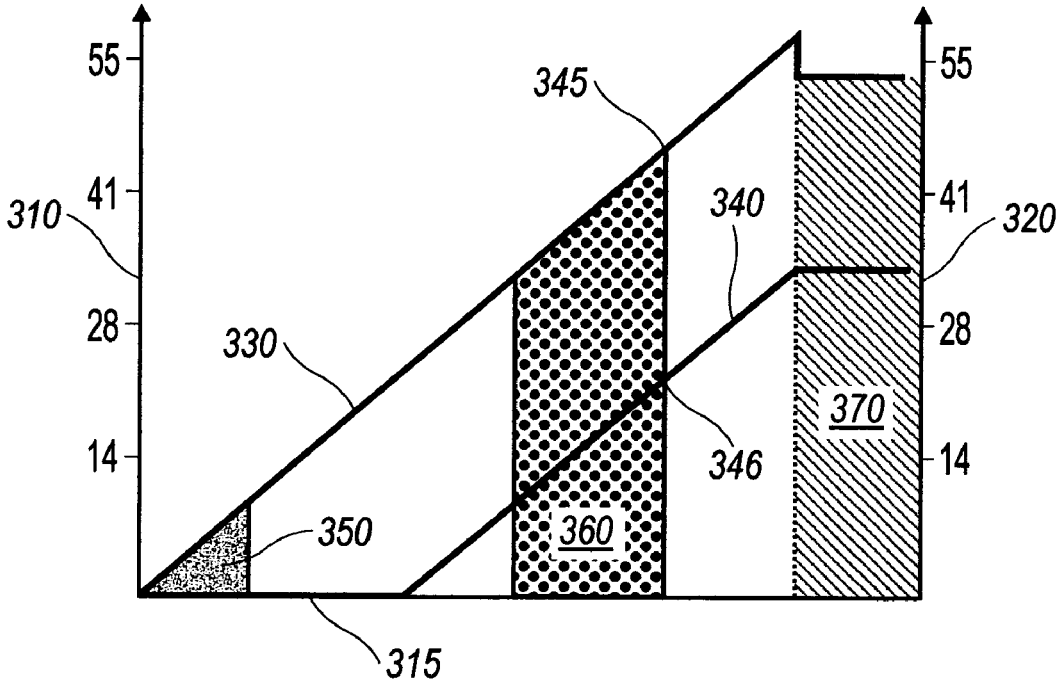
FIG. 3 is a graphic illustration of a pressure actuation sequence prior to fracturing for a single-trip, multi-zone hydraulic fracturing operation.
Figure 4:
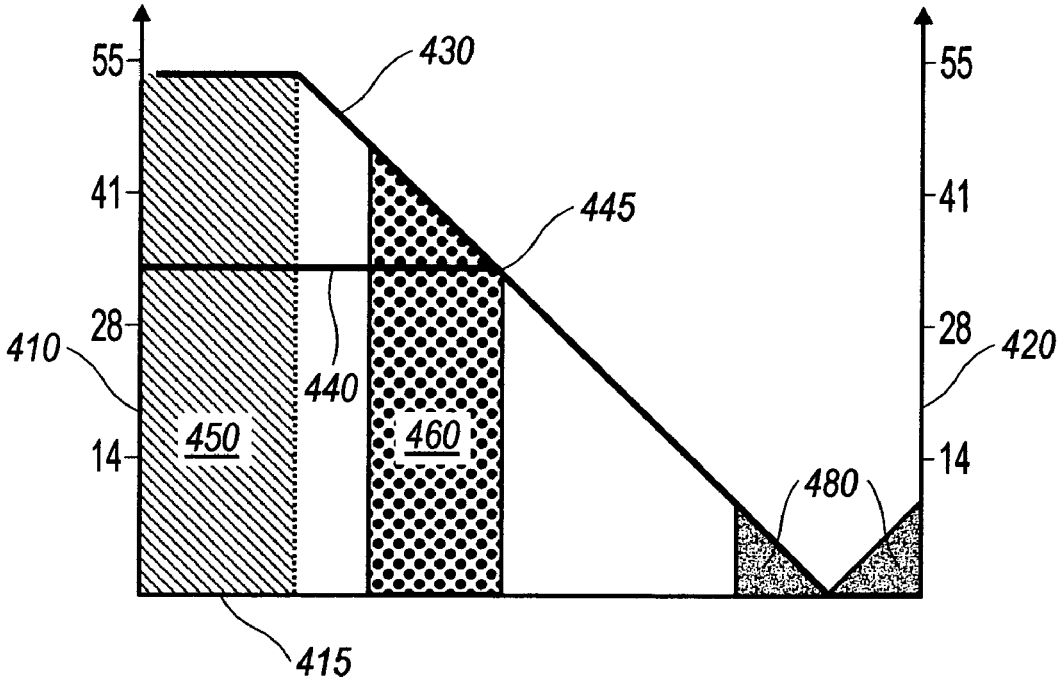
FIG. 4 illustrates a pressure actuation sequence after fracturing has occurred for a single-trip, multi-zone hydraulic fracturing operation.

The pressure actuation process is graphically presented in FIG. 3 and FIG. 4 as a function of time. FIG. 3 is a graphic illustration of a pressure actuation sequence prior to fracturing for a single-trip, multi-zone hydraulic fracturing operation. FIG. 3 is a graph having an ordinate 310 representing coiled tubing pressure in MPa, an ordinate 320 representing packer pressure in MPa, an abscissa 315 representing time (increasing from left to right), a line 330 representing changing coiled tubing pressure, a line 340 representing changing packer pressure, a point 345 representing coiled tubing pressure when the equalization port becomes fully closed, a point 346 representing packer pressure when the equalization port becomes fully closed, an interval 350 representing pressure during wash tool operation, an interval 360 representing pressure during pilot operated relief valve actuation, and an interval 370 representing pressure during the fracturing job. FIG. 4 illustrates a pressure actuation sequence after fracturing has occurred for a single-trip, multi-zone hydraulic fracturing operation as a function of time. FIG. 4 is a graph having an ordinate 410 representing coiled tubing pressure in MPa, an ordinate 420 representing packer pressure in MPa, an abscissa 415 representing time (increasing from left to right), a line 430 representing changing coiled tubing pressure, a line 440 representing changing packer pressure, a point 445 representing coiled tubing pressure and packer pressure when the equalization port becomes fully opened, an interval 450 representing pressure during the fracturing job, an interval 460 representing pressure during opening of the pilot operated relief valve, and an interval 480 representing pressure during wash tool operation. Referring now to FIG. 1 and FIG. 2, the operation begins by lowering the downhole assembly 5 from the surface to the interval of interest while circulating fluid through wash tool 24. Circulation is enabled by pumping into the coiled tubing 7 at rates that limit the differential pressure across the RILV to between 0 MPa and about 10 MPa (0 and 1500 psi). In this pressure range the packer inflation valve family 30 is closed and equalization valve family 40 is opened. When the select-fire perforating system 9 reaches the desired depth, one set of the perforating guns is discharged. While continuing flow through wash tool family 20 to remove residual perforation debris, downhole assembly 5 is lowered below the perforations to the desired packer setting location, and slips 25 are set. Increasing the RILV differential pressure above about 10 MPa (1500 psi) closes velocity fuse valve 21 and terminates flow to wash tool 24. Throughout the operational cycle, check valves 22, 23, and 26 of wash tool family 20 protect against flow from annulus 11 into coiled tubing 7. Over the pressure range from about 10 MPa to about 24 MPa (1500 psi to 3500 psi) wash tool family 20 and packer inflation valve family 30 are closed and equalization family 40 is opened. At about 24 MPa (3500 psi), relief valve 31 of packer inflation valve family 30 opens and the packer begins to inflate. Fluid entering the packer inflation valve family 30 is filtered as it passes through screens 37. Orifice 39 meters the rate of fluid flow into the packer during inflation. Equalization family 40 remains opened during the inflation interval between about 24 MPa and about 34 MPa (3500 and 5000 psi), after which the packer is firmly seated against the casing walls and pilot operated relief valve 41 of equalization family 40 begins to close. Throughout the operational cycle, check valves 42 and 43 of equalization family 40 protect against the development of elevated pressures below the packer. Increasing the coiled tubing pressure to about 59 MPa (8500 psi) generates a packer pressure of 5000 psi. Dropping the coiled tubing pressure from about 59 MPa to about 55 MPa (8500 psi to 8000 psi) leaves about 34 MPa (5000 psi) within the packer and provides a pressure cushion for moderate surface pressure fluctuations.

At this point the fracturing operation occurs. Proppant laden fluid is pumped through the annulus between the coiled tubing and casing into the perforations above the inflated packer. After the fracturing operation is completed, the possibility exists that an accumulation of settled proppant resides above the packer and below the perforations, as well as that, a pressure imbalance may exist across the packer. The accumulation of settled proppant occurs if the gel strength is not sufficient to ensure that all particles followed the streamlines into perforations. Any particles that are unable to follow the streamlines are ejected into the region below the lowest perforation, and thus settle onto the packer. Proppant can also accumulate above the packer if a proppant laden fracturing gel is allowed to break within the wellbore during upset conditions. A pressure imbalance occurs if a single low pressure zone is isolated below the packer. A high pressure zone below the packer would be readily equalized upon completion of the fracture operation via check valves 42 and 43 of equalization family 40.

Following the fracture operation the pressure within the packer is about 34 MPa (5000 psi) and the coiled tubing pressure is about 55 MPa (8000 psi). Decreasing the coiled tubing pressure to 7500 psi begins opening pilot operated relief valve 41 of equalization family 40. This enables pressure and fluid communication across the packer. This pressure equalization path remains opened for the remainder of the operations. Within the coiled tubing pressure interval of about 59 MPa to about 34 MPa (8500 psi to 5000 psi) the packer remains inflated to about 34 MPa (5000 psi) and wash tool family 20 remains closed. When the coiled tubing pressure drops below about 34 MPa (5000 psi) the packer begins to deflate via check valves 32 and 33 of packer inflation family 30. To protect check valves 32 and 33 from potential damage resulting from the ejection of high velocity deflation fluid, orifices 38 restrict the rate of fluid flow out of the packer to an acceptable level. Below a coiled tubing pressure of about 34 MPa (5000 psi) the packer pressure tracks with the coiled tubing pressure. At a coiled tubing pressure of about 10 MPa (1500 psi), velocity fuse 21 of wash tool family 20 begins to open. The accumulated proppant is washed off the inflated packer by decreasing the coiled tubing pressure to a level that achieves the desired flow rate through the wash tool, assume about 7 MPa (1000 psi) for this case. At about 7 MPa (1000 psi) the packer remains inflated, thus the washing operation necessarily displaces the proppant uphole and away from the packer. If it is deemed beneficial to wash the accumulated sand while the packer is deflated, the coiled tubing pressure is dropped to 0 MPa (0 psi). This allows the packer to deflate. After the packer is deflated, the coiled tubing pressure is then increased to a level that achieves the desired flow rate through the wash tool. The increase in coiled tubing pressure does not re-inflate the packer because relief valve 31 of packer inflation family 30 will not re-open again until the coiled tubing pressure reaches about 24 MPa (3500 psi).

After the downhole tool assembly is adequately freed from the sand pack, and the packer is deflated, the coiled tubing pressure is set between 0 MPa about 10 MPa (0 and 1500 psi) to enable circulation. The downhole tool assembly is then moved uphole to the next perforating location. The fore mentioned cycle is then repeated as many times as required by the stimulation program. The downhole tool assembly is then tripped to the surface to receive a new set of select-fire perforating guns for the next set of intervals, or removed from the wellbore if the program is complete.

In the event that the packer could not be deflated, then the coiled tubing pressure could be increased to about 65 MPa (9500 psi) (which produces about 41 MPa (6000 psi) in the packer) and the burst disk 44 ruptured, in order to deflate the packer.

Figure 5:
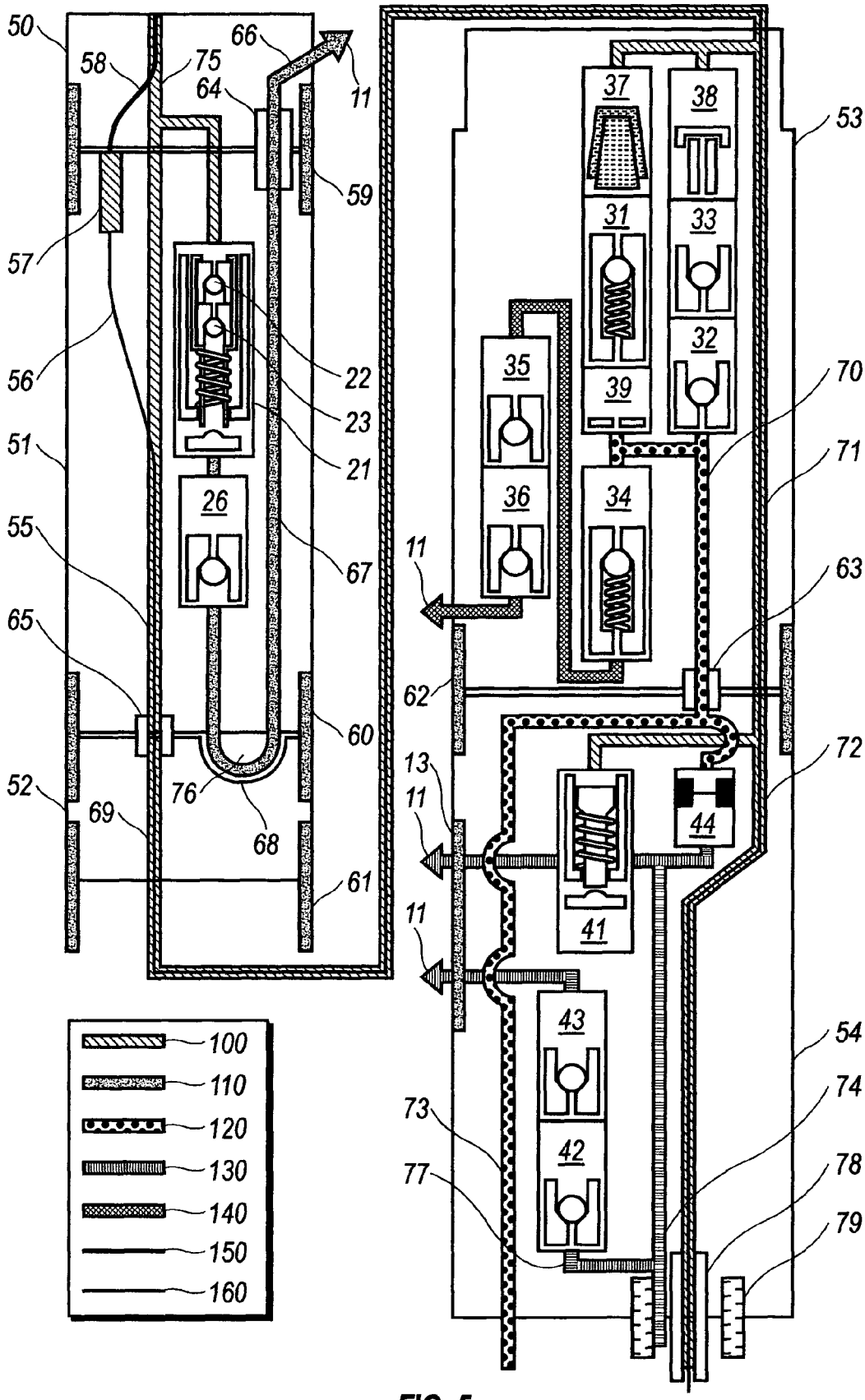
FIG. 5 is a schematic diagram of one embodiment of an RILV hardware design.

FIG. 5 illustrates one embodiment of the apparatus of the present invention. RILV 10 is comprised of five subassemblies 50, 51, 52, 53, 54 that house the various cartridge valves.

The five sub assemblies connect together in the order illustrated in FIG. 5, i.e., 50 to 51, 51 to 52, 52 to 53, and 53 to 54. Any suitable means of connecting the sub assemblies may be used. Upon assembly, each subassembly communicates with the next through pressure isolating connection nipples 63, 64, and 65, within the confines of the pressure isolating subassembly connection sleeves 59, 60, 61, 62. The cartridge valves are easily replaceable by detaching between subassemblies, at an appropriate location, and inserting a pre-tested valve. Wireline communication is provided throughout the tool. In FIG. 5, hatching 100 represents coiled tubing fluid, hatching 110 represents wash fluid, hatching 120 represents packer inflation/deflation fluid, hatching 130 represents equalization fluid, hatching 140 represents packer overinflation fluid, hatching 150 represents wireline, and hatching 160 represents conductor wire.

Subassembly 50 attaches to coiled tubing connections 12 and contains wash tool 24 exits jets (see FIG. 1). Wash tool fluid passage 66 is provided from subassembly 51 through a pressure isolating connection nipple 64. Wash fluid exits subassembly 50 through screen 15 (see FIG. 2). Subassembly 50 connects to subassembly 51 and isolates the coiled tubing pressure, transmitted through coiled tubing pressure passage 75, from the pressure in annulus 11 via connection sleeve 59. Subassembly 51 comprises a wash tool circuit velocity fuse valve 21, flapper check valves 22, 23, and 26, a wireline release socket 57, wash fluid passage 67, as well as a conductor wire and coiled tubing fluid passage 55. The conductor wire and coiled tubing fluid passage 55 is communicated to subassembly 52 through pressure isolating connection nipple 65. Standard oilfield conductor wireline (e-line) passes through subassembly 50 and attaches to the wireline release socket 57 in subassembly 51. Electrical continuity is maintained by attaching a conductor wire extension 56 to the e-line's conductor wire 58. Subassembly 51 connects to subassembly 52 and isolates the wash fluid pressure 76 from pressure in annulus 11 via connection sleeve 60.

Subassembly 52 comprises a wash tool fluid re-direction bowl 68, as well as a conductor wire and coiled tubing fluid passage 69. Subassembly 52 connects to subassembly 53 and isolates the coiled tubing pressure in coiled tubing fluid passage 69 from pressure in annulus 11 via connection sleeve 61.

Subassembly 53 comprises packer inflation screens 37, a packer inflation relief valve 31, packer inflation orifice 39, packer deflation dual check valves 32 and 33, packer deflation orifices 38, packer over-inflation relief valve 34 with dual check valves 35 and 36, a conductor wire and coiled tubing passage 71, and a packer inflation fluid pressure passage 70. The packer fluid passage is communicated to subassembly 54 through pressure isolating connection nipple 63. Subassembly 53 connects to subassembly 54 and isolates the coiled tubing pressure in passage 71 from pressure in annulus 11 via connection sleeve 62.

Subassembly 54 comprises a burst disk 44, a pilot operated relief valve 41, equalization fluid passage 74, and upflow equalization path 77 with dual check valves 42 and 43. The packer mandrel and packer inflatable element may connect directly to subassembly 54. Packer inflation fluid flows directly into the packer via packer fluid passage 73. Conductor wire and coiled tubing fluid passage 72 exit subassembly 54 into a pressure isolating coiled tubing passage tube 78 that passes through the center of mandrel 79 and then terminates below mandrel 79. Equalization fluid passage 74 passes through the annulus formed between the inside mandrel 79 and the outside of the conductor wire and coiled tubing passage tube 78. Equalization fluid communication is established through screen 13 on subassembly 54, through the annulus formed between mandrel 79 and conductor wire and coiled tubing passage tube 78, and through screen 14 (see FIG. 1) attached to the bottom of mandrel 79. In one embodiment, one or more of screens 13, 14, and 15, all as shown in the drawings, is a 100 to 150 micron, wire-wrap screen.

In another embodiment of the invention, the RILV may be designed with coiled tubing pressure communication below the device such that another pressure actuated device (or another circuit based device) could be connected to it, for example a straddle packer system. In a further embodiment, timing events may be actuated using flow through an orifice that fills one end of an accumulator which moves a floating piston from one end to the other to actuate a lever or switch. In yet another embodiment, in an analogous fashion to an electrical circuit based breadboard, a valve body breadboard could be constructed to house multiple cartridge valves. The valve housing breadboard could be constructed such that various valves could be installed in a flexible fashion so that any number of downhole event sequences (stimulation programs) could be programmed within the housing of a single tool.

In another embodiment, the pressure actuated RILV circuit can also be used to operate or control a remote electrical device(s) or circuit(s) that would communicate with a command base via a wireline, or operate a remote electrical device(s) or circuit(s) that is powered at the remote location and requires no wireline support. This operation could be performed at a predefined interval(s) during a pressure actuation sequence. For example, when a certain pressure was reached, an electrically energized select-fire perforating gun could be discharged during the pressure cycle of an intervention activity.

In yet another embodiment, the packer pressure line in the RILV can be connected to the pilot operated relief valve (instead of the coiled tubing pressure line as shown in FIG. 2). This will allow the pilot operated relief valve to open fully until sufficient pressure builds in the packer to close it. Pressure only builds in the packer after it is seated against the casing walls. The pilot operated relief valve can then be closed at a packer pressure of about 10 MPa (1500 psi).

The application of the present invention is not limited to the examples given herein. The system of valves disclosed can be utilized to actuate performance of various sequenced sets of events with the application of pressure to said valves including, but not limited to, packer actuation, pressure equalization, wash-fluid flow actuation, perforating device actuation, slips actuation, wire line actuation, electrical device actuation, measurement device actuation, sampling device actuation, deployment means actuation, downhole motor actuation, generator actuation, pump actuation, communication system actuation, fluid injection, fluid removal, heating, cooling, bridge plug actuation, frac plug actuation, optical device actuation, BHA release actuation, drilling operation, cutting operation, expandable tubing operation, expandable completion, operation, and mechanical device actuation. Those skilled in the art will recognize many other useful applications of the present invention.

The foregoing description has been directed to particular embodiments of the invention for the purpose of illustrating the invention, and is not to be construed as limiting the scope of the invention. It will be apparent to persons skilled in the art that many modifications and variations not specifically mentioned in the foregoing description will be equivalent in function for the purposes of this invention. All such modifications, variations, alternatives, and equivalents are intended to be within the spirit and scope of the present invention, as defined by the appended claims.

We claim:

1. A system comprising two or more valves fluidically coupled to a deployment means; wherein each of said valves independently operates over its designated pressure interval based on applied pressure in the system; and wherein the two or more valves are arranged to autonomously actuate performance of a sequenced set of events by one or more downhole tools based on an applied fluid pressure in the system to the two or more valves.

2. The system of claim 1 wherein one or more of said valves is a cartridge valve.

3. The system of claim 2 wherein at least one of said cartridge valves is a single purpose cartridge valve.

4. The system of claim 1 wherein one or more of said valves is an annular-based valve.

5. The system of claim 1 wherein said set of events are selected from the group consisting of packer actuation, pressure equalization, wash-fluid flow actuation, perforating device actuation, slips actuation, wire line actuation, electrical device actuation, measurement device actuation, sampling device actuation, deployment means actuation, downhole motor actuation, generator actuation, pump actuation, communication system actuation, fluid injection, fluid removal, heating, cooling, bridge plug actuation, frac plug actuation, optical device actuation, BHA release actuation, drilling operation, cutting operation, expandable tubing operation, expandable completion operation, and mechanical device actuation.

6. The system of claim 1 wherein said valves operate one or more remote electrical devices that communicate with a command base via a wireline.

7. The system of claim 1 wherein said valves operate one or more remote electrical devices that are powered at a remote location without requiring wireline support.

8. The system of claim 1 wherein at least one of said valves is adapted to allow fluid to flow therethrough in only one direction.

9. The system of claim 1 wherein at least one of said valves is adapted to cause fluid flow therethrough to cease when said fluid flow reaches a predefined rate or imposes a predefined pressure upon said valve.

10. The system of claim 1 wherein at least one of said valves is adapted to allow fluid to flow therethrough when said fluid flow imposes a predefined pressure upon said valve.

11. The system of claim 1 comprising at least one screen adapted to filter solids having predefined dimensions from fluids before said fluids flow through one or more of said valves.

12. The system of claim 1 comprising at least one burst disk adapted to allow fluid flow out of one or more of said downhole tools under one or more predefined conditions.

13. The system of claim 1 comprising one or more orifices adapted to limit flow of fluid through said system to a predefined flowrate.

14. The system of claim 1 comprising one or more orifices adapted to limit flow of fluid through one or more of said valves to a predefined flowrate.

15. A method for perforating and treating multiple intervals of one or more subterranean formations intersected by a wellbore, said method comprising the steps of:

(a) deploying a bottom-hole assembly ("BHA") utilizing a tubing string within said wellbore, said BHA having a perforating device and a sealing mechanism;

(b) using said perforating device to perforate at least one interval of said one or more subterranean formations;

(c) positioning said BHA within said wellbore and activating said sealing mechanism so as to establish a hydraulic seal below said at least one perforated interval;

(d) pumping a treating fluid down the annulus between said tubing string and said wellbore and into the perforations created by said perforating device, without removing said perforating device from said wellbore;

(e) releasing said sealing mechanism; and (f) repeating steps (b) through (e) for at least one additional interval of said one or more subterranean formations; wherein at least two of said steps are actuated by a system of two or more valves fluidically coupled to the tubing string, wherein each of said valves independently operates over its designated pressure interval based on applied pressure in the BHA and is configured to independently actuate one or more downhole tools in response to applied fluid pressure in the valve's designed pressure interval, and wherein the two or more valves are arranged to autonomously actuate performance of said two or more steps based on an applied fluid pressure on the system of valves through the BHA.

16. The method of claim 15 wherein additional steps are performed, said steps being selected from the group consisting of washing debris from around said sealing mechanism, equalizing pressure across said sealing mechanism, and establishing electrical communication through said sealing mechanism.

17. An apparatus for actuating performance of a sequenced set of events by one or more downhole tools, the apparatus comprising a combination of two or more valves arranged within sub-assemblies and fluidically connected by a deployment means; wherein one sub-assembly communicates with another sub-assembly through pressure isolating connections, and wherein the combination of two or more valves autonomously actuates performance of the sequenced set of events by one or more downhole tools based on an applied fluid pressure in the apparatus to the combination of two or more valves.

18. The apparatus of claim 17 wherein said valves are cartridge valves housed within said sub-assemblies.

19. The apparatus of claim 17 wherein pressure communication is established both between said valves and between said sub-assemblies by said pressure isolating connections.

20. The apparatus of claim 17 wherein wireline communication is provided through said sub-assemblies.

21. The apparatus of claim 17 wherein at least one of said valves is adapted to allow fluid to flow therethrough in only one direction.

22. The apparatus of claim 17 wherein at least one of said valves is adapted to cause fluid flow therethrough to cease when said fluid flow reaches a predefined rate or imposes a predefined pressure upon said valve.

23. The apparatus of claim 17 wherein at least one of said valves is adapted to allow fluid to flow therethrough when said fluid flow imposes a predefined pressure upon said valve.

24. The apparatus of claim 17 comprising at least one screen adapted to filter solids having predefined dimensions from fluids before said fluids flow through one or more of said valves.

25. The apparatus of claim 17 comprising at least one burst disk adapted to allow fluid flow out of one or more of said downhole tools under one or more predefined conditions.

26. The apparatus of claim 17 comprising one or more orifices adapted to limit flow of fluid through one or more of said valves to a predefined flowrate.

* * * * *